US006220784B1

(12) United States Patent
Bricker

(10) Patent No.: US 6,220,784 B1
(45) Date of Patent: Apr. 24, 2001

(54) METHOD AND APPARATUS FOR FORMING A TRENCH

(76) Inventor: Albert W. Bricker, 777 Gresham Ave., Atlanta, GA (US) 30316

( * ) Notice: Subject to any disclaimer, the term of this patent is extended or adjusted under 35 U.S.C. 154(b) by 0 days.

(21) Appl. No.: 09/252,320

(22) Filed: Feb. 18, 1999

Related U.S. Application Data

(60) Provisional application No. 60/075,065, filed on Feb. 18, 1998.

(51) Int. Cl.[7] ..... E02B 5/00

(52) U.S. Cl. ..... 405/118; 405/119; 405/121; 405/123; 249/10; 249/11; 404/2; 404/3

(58) Field of Search ..... 405/118, 119, 405/120, 121; 249/10, 11, 12, 13; 404/2, 3, 4

(56) References Cited

U.S. PATENT DOCUMENTS

| | | | | |
|---|---|---|---|---|
| 3,299,785 | * | 1/1967 | James | 404/4 |
| 4,844,655 | * | 7/1989 | Aleshire | 405/118 |
| 4,993,877 | | 2/1991 | Beamer | 405/282 |
| 4,993,878 | | 2/1991 | Beamer | 405/282 |
| 5,000,621 | | 3/1991 | Beamer | 405/282 |
| 5,066,165 | | 11/1991 | Wofford et al. | 405/119 |
| 5,226,748 | | 7/1993 | Barenwald et al. | 405/121 |
| 5,256,000 | | 10/1993 | Beamer | 405/119 |
| 5,281,051 | | 1/1994 | Stegall | 405/118 |
| 5,281,052 | | 1/1994 | Beamer | 405/119 |
| 5,326,189 | | 7/1994 | Beamer | 405/119 |
| 5,326,190 | | 7/1994 | Beamer | 405/119 |
| 5,340,234 | | 8/1994 | Rosski et al. . | |
| 5,348,421 | | 9/1994 | Stegall . | |
| 5,393,171 | | 2/1995 | Stegall | 405/119 |
| 5,399,047 | | 3/1995 | Stegall | 405/119 |
| 5,478,169 | | 12/1995 | Stegall | 405/119 |

(List continued on next page.)

OTHER PUBLICATIONS

Brochure entitled "TF–14—Trench Drain Forming System Design Manual"; distributed by ABT, Inc. 12 pgs. (Undated).

Brochure entitled "Trench Former—Installation Guide"; distributed by ABT, Inc.; 11 pgs. (Undated).

Brochure entitled "EconoDrain by MultiDrain—Installation Instructions"; distributed by MultiDrain Corporation; pp. 3–6 (Undated).

Chart entitled "Comparison of EconoDrain Versus Competition"; 1 pg.

Brochure entitled "MultiDrain—Introducing a New Breakthrough in Surface Draining Systems."; distributed by MultiDrain Corporation; 8 pgs. (Undated).

Brochure entitled "EconoDrain by MultiDrain—The Most economical trench drainage system"; distributed by MultiDrain Corporation; 8 pgs. (Undated).

Brochure entitled "EconoDrain by MultiDrain—Installation Bulletin"; distributed by MultiDrain Corporation; 6 pgs. (Undated).

*Primary Examiner*—Eileen D. Lillis
*Assistant Examiner*—Jong-Suk Lee
(74) *Attorney, Agent, or Firm*—Thomas, Kayden, Horstemeyer & Risley LLP

(57) ABSTRACT

An apparatus for forming a trench which is adapted to receive at least one grate that will cover the trench. The apparatus comprises first and second frame rails that are connected by at least one removable spacer. The spacer is sized and configured to maintain proper alignment and spacing between the first and second frame rails during the formation of the trench. The removable spacer is connected to the first and second frame rails with spacer securing means. In addition to securing the at least one spacer to the first and second frame rails, the securing means also can be used to fixedly secure the at least one grate in place on the first and second frame rails.

22 Claims, 8 Drawing Sheets

U.S. PATENT DOCUMENTS

| | | | |
|---|---|---|---|
| 5,522,675 | 6/1996 | Gunter | 405/118 |
| 5,538,361 | 7/1996 | Beamer | 405/118 |
| 5,568,995 | 10/1996 | Beamer | 405/119 |
| 5,573,350 | 11/1996 | Stegall | 405/119 |
| 5,573,351 | 11/1996 | Beamer | 405/119 |
| 5,613,804 | 3/1997 | Beamer | 405/119 |
| 5,702,204 | 12/1997 | Gunter | 405/119 |
| 5,718,537 | 2/1998 | Becker et al. | 405/119 |
| 5,735,637 | 4/1998 | Gunter | 405/118 |
| 5,735,638 | 4/1998 | Beamer | 405/119 |
| 5,803,662 * | 9/1998 | Gunter | 405/119 |
| 5,810,513 | 9/1998 | Beamer et al. | 405/119 |

* cited by examiner

METHOD AND APPARATUS FOR FORMING A TRENCH

CROSS REFERENCE TO RELATED APPLICATION

Applicant hereby claims priority to and incorporates by reference U.S. Provisional Application Ser. No. 60/075,065, filed Feb. 18, 1998.

FIELD OF THE INVENTION

The present invention relates generally to the construction industry and more specifically to apparatus used in constructing grate-covered trenches.

BACKGROUND OF THE INVENTION

The use of concrete lined, grate or solid covered trenches are well known in the road, parking lot, and manufacturing plant construction industry. The typical trench construction includes a pair of spaced rails, wherein each rail has a grate supporting surface upon which a central grate rests. FIGS. 1 and 2 illustrate a typical prior art trench-forming assembly 10. Each rail 12, 14 is made of a rigid material which preferably can be easily and inexpensively molded, cast, extruded, or stamped into a desired rail shape. As indicated in these figures, each rail 12, 14 can be Z-shaped in cross-section and connected by a connecting rod 16 which typically is attached to the rails by welding to an inside surface 17 of each rail. When such connecting rods 16 are used, at least two such connecting rods are placed between each set of rails, typically with one rod positioned at the end of each rod pair. The connecting rods 16 are used to maintain the rails 12, 14 in a fixed position relative to each other prior to and during the curing of the hardenable material used to form the completed trench.

Adjustable anchoring means typically are used to adjust the slope and height of the rails 12, 14. As indicated in FIGS. 1 and 2, one such means includes a connecting member 18 that extends outwardly from an outside surface 20 of the rails 12, 14 to connect to an anchor rod 22 that is adapted to be driven into the ground at the bottom of the excavated trench. As is further indicated in the figures, the connecting member 18 includes a collar 24 through which the rod 22 can be passed. Each collar 24 includes a fastening member such as a thumb screw 26 which is threadingly inserted into an aperture formed within each collar so that, when the fastening member is tightened, the connecting member 18 can be fixed relative to the rod 22 such that the rails 12, 14 can be supported by the rods in the desired position.

The prior art assembly 10 of FIGS. 1 and 2 further includes a form 28. Although capable of alternative construction, the form 28 typically is made of an expanded polystyrene foam which is adapted to be held in a fixed position between the rails 12, 14. The form 142 normally includes an upper surface 30 and a shaped lower surface 32. The lower surface 32 can be shaped into any contour, but preferably is tapered from the upper surface 30 to facilitate simple removal from the final trench. In the embodiment illustrated in FIGS. 1 and 2, a plurality of grooves 34 are formed in the upper surface 30 of the form 28 to receive each connecting rod 16 provided along the rails 12, 14. The grooves 34 allow each connecting rod 16 to laterally traverse the form 28 to secure the form 28 in position while held between the rails 12, 14 as shown in FIG. 2. Once the assembly is arranged as illustrated in FIG. 2 and the anchoring means adjusted into the desired position, hardnenable material (typically concrete) is poured into the excavated trench to surround the form 28. After the hardenable material has cured, the form 28 can be removed to reveal a completed trench having the contours of the lower surface 32 of the form 128. To facilitate removal of the form 28, however, the connecting rods 16 first must be removed from the rails 12, 14. In that the connecting rods 16 usually are welded to the rails, the rods typically must be cut from the rails with an electric grinder or saw.

Although adequately functional in design, there are several disadvantages associated with the prior art forming system set out in FIGS. 1 and 2. First, the upward buoyancy forces exerted on the form 28 often is sufficient to deepen the grooves 34 which receive the connecting rods 16. As a result, the form 28 can be displaced upwardly, resulting in an uneven trench bottom surface. This result is particularly disadvantageous to the liquid displacing function of the trench in that it can create stagnant puddles of liquid therein. Furthermore, the connecting rods 16 can deform into an upwardly convex orientation, especially in wider form applications, due to the buoyancy forces imposed by the hardenable material. This deformation can cause misalignment or twisting of the frames, and can result in an uneven bottom trench surface, as described above.

Another disadvantage associated with the assembly illustrated in FIGS. 1 and 2, and other similar known systems, pertains to the attachment and removal of the connecting rods. Specifically, additional labor is required to weld each of the rods between the rails, which increases the cost and complexity of the assembly and makes it less economical to manufacture. In addition to the unnecessary labor associated with attachment of the connecting rods, additional labor is needed to remove them. Because the connecting rods normally must be cut away from the rails, the welded rod feature requires the presence of electrical power on a construction site or the use of gasoline powered tools. In the absence of such equipment, a hack saw must be used, making the removal of the form extremely labor intensive and quite expensive.

From the above, it can be appreciated that it would be advantageous to have a form assembly which is more resistant to the buoyancy forces imposed by the hardenable material, and which is less difficult to use.

SUMMARY OF THE INVENTION

Generally speaking, the present invention relates to an apparatus for forming a trench which is adapted to receive at least one grate that will cover the trench. The apparatus comprises first and second frame rails that are connected by at least one removable spacer. The spacer is sized and configured to maintain proper alignment and spacing between the first and second frame rails during the formation of the trench. The removable spacer is connected to the first and second frame rails with spacer securing means.

Once the first and second frame rails have been connected with the spacer securing means, the frame rails can be positioned within the excavated trench in a desired orientation. At this point, a hardenable material such as concrete can be poured into the excavated trench to surround the first and second frame rails. Once the hardenable material has cured to an adequate degree, the at least one removable spacer can be removed from the first and second frame rails and replaced with one or more grates. Typically these grates are fixedly secured to the first and second frame rails by using at least a portion of the securing means that was used to releasably secure the at least one spacer to the first and second frame rails. In that the securing means is used to secure both the at least one spacer and the one or more grates, the apparatus of the present invention can be more economically manufactured and more easily used.

The objects, features, and advantages of the present invention will become apparent upon reading of the following specification when taken in conjunction with the accompanying drawings.

BRIEF DESCRIPTION OF TIE DRAWINGS

The accompanying drawings incorporated in and forming a part of the specification illustrate several aspects of the present invention, and together with the description service to explain the principles of the invention. The components in the drawings are not necessarily to scale, emphasis instead being placed upon clearly illustrating principles of the present invention. In the drawings appended hereto, like numerals illustrate lie parts throughout the several views.

Figure 1:
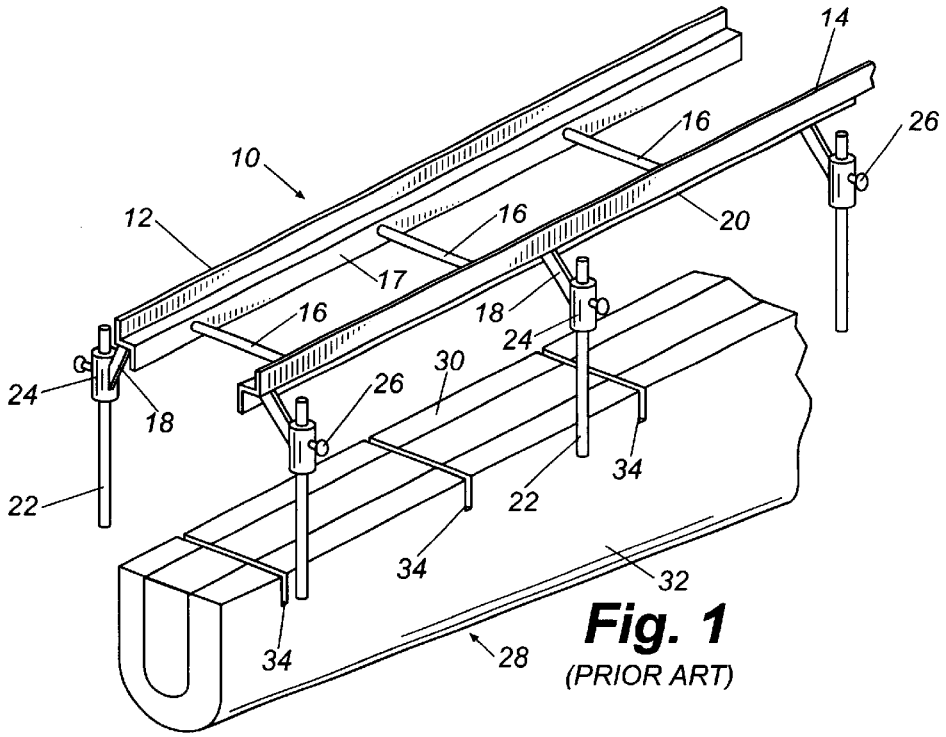
Fig. 1 (PRIOR ART)
FIG. 1 illustrates an exploded perspective view of a prior art trench-forming assembly.
Figure 2:
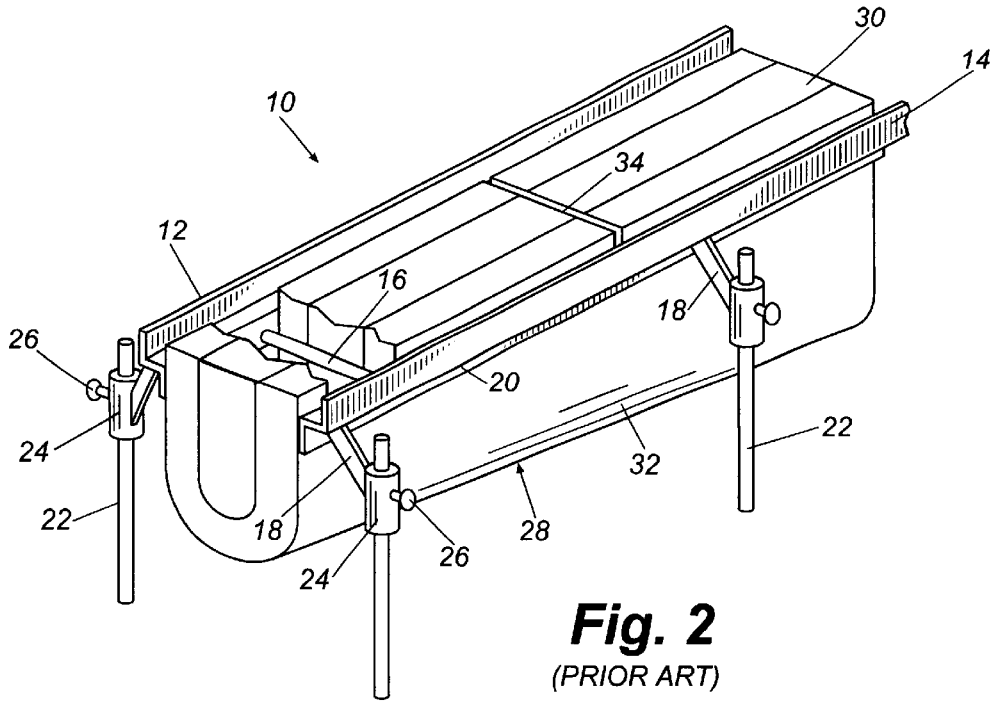
Fig. 2 (PRIOR ART)
FIG. 2 illustrates a perspective view of the assembly of FIG. 1, shown in an assembled state.

Reference will now be made in detail to the description of the invention as illustrated in the drawings. While the invention will be described in connection with these drawings, there is no intent to limit it to the embodiment or embodiments disclosed therein. On the contrary, the intent is to cover all alternatives, modifications, and equivalents included within the spirit and scope of the invention as defined by the appended claims.

DETAILED DESCRIPTION

Referring now in more detail to the drawings in which like numerals indicate corresponding parts through the several views, FIGS. 3–6 illustrate a first embodiment of trench-forming apparatus 100 constructed in accordance with the present invention. As is most clearly apparent from FIG. 3, the apparatus 100 generally comprises first and second frame rails 112 and 114, and a removable form 116. Typically, each frame rail 112, 114 comprises a vertical first portion 118, a horizontal portion 120, and a second vertical portion 122. The first vertical portion 118 extends upwardly from the horizontal portion 120 and the second vertical portion 122 extends downwardly from the horizontal portion such that each frame rail 112, 114 is substantially Z-shaped in cross-section. Although a substantially Z-shaped cross-section is preferred, it is to be understood that alternative shapes could be used in lieu of the Z-shape, as desired.

The frame rails 112, 114 normally are constructed of a rigid material such as a metal or a polymeric material. Preferably, the rigid material is galvanized, painted, or unpainted steel, cast or extruded aluminum, or cast iron. The horizontal portion 120 of each frame rail 112, 114 is provided with a plurality of openings 124, the purpose for which will be described below. Each opening 124 extends from a top surface 126 of the horizontal portion 120 to a bottom surface 128 of the horizontal portion so as to pass completely through the horizontal portion of each frame rail 112, 114. Normally, the openings 124 are arranged in pairs 130 along the length of the horizontal portion 120 to facilitate lock-down of grates which will be placed atop the trench when completed.

Figure 3:
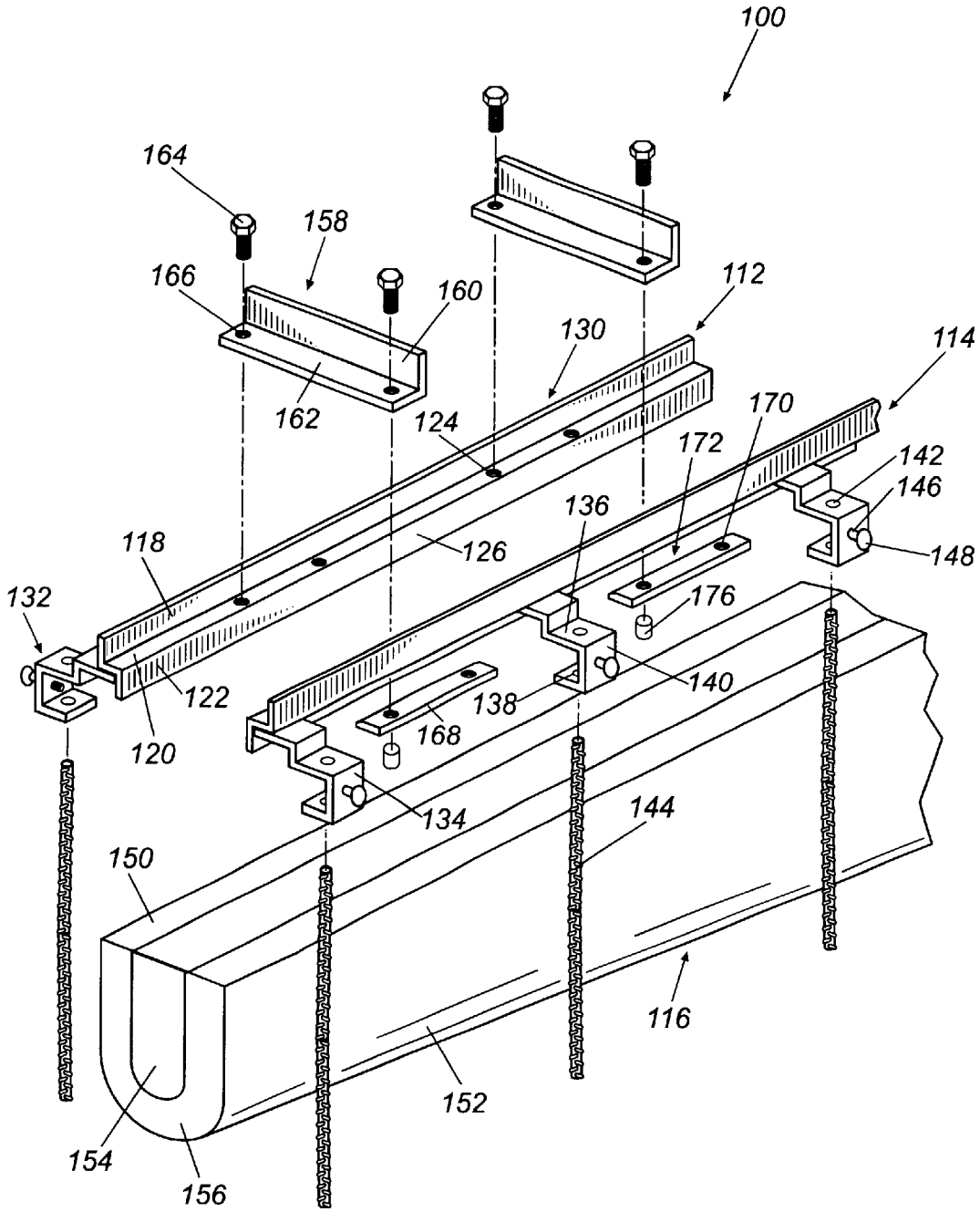
FIG. 3 illustrates an exploded perspective view of a first embodiment of trench forming apparatus constructed in accordance with the present invention.

Attached to the bottom surface 128 of each frame rail 112, 114 in the first embodiment is a plurality of support members 132 which are fixedly attached thereto. As indicated in FIG. 3, each of these support members 132 is positioned incrementally along the length of each frame rail 112, 114 and extends outwardly therefrom. Typically, each support member 132 extends perpendicularly outward from its associated frame rail 112, 114, although alternative configurations are possible. In a preferred embodiment, each support member 132 can be configured as a support bracket 134. Normally, each support bracket 134 is formed of flat bar and is welded to the underside of each frame rail 112, 114. The support brackets 134 shown in FIG. 3 each includes at least a first and second horizontal portions 136 and 138, as well as at least one vertical portion 140. Each of the horizontal portions 136, 138 is provided with a support rod opening 142 which is adapted to receive a support rod 144. Usually, each support rod comprises a steel rod commonly known as rebar, although alternative rigid materials could be used with similar results. In addition to the support rod openings 142, each support bracket 134 further is provided with a threaded fastener opening 146. Preferably, the fastener opening 146 is provided in the vertical portion 140 of each support bracket 134 and is sized and configured to receive a fastener 148 such as a screw or bolt.

As is further indicated in FIG. 3, the form 116 is substantially elongated in shape and comprises an upper surface 150 as well as a lower surface 152. Typically, the upper surface 150 is substantially flat in shape and the lower surface 152 is substantially U-shaped. It is to be understood, however, that the shape of the lower surface can be varied to produce any resultant trench shape that is desired. Accordingly, the lower surface alternatively could be substantially square shaped in cross-section, substantially V-shaped in cross-section, or arranged in substantially any other shape. In a preferred configuration, the removable form 116 is composed of expanded polystyrene (EPS) and comprises two separate sections, an inner core 154 and an outer shell 156. This material and the above-described construction facilitates simple removal of the removable form 116 after the hardenable material has been poured into the excavated trench. In that it typically is desirable to have a sloped trench bottom, the lower surface 152 of the form normally is not parallel to the upper surface 150 of the form as shown in FIG. 3.

In addition to the frame rails 112, 114 and the removable form 116, the form assembly 100 further includes rail spacing means. In the embodiment depicted in FIG. 3, these spacing means include a spacer such as a cross-member 158 which is configured to maintain the proper separation distance between the first and second frame rails 112 and 114. In a preferred arrangement, each cross-member 158 is provided with a vertical portion 160 and a horizontal portion 162 and therefore is configured as an angle member. In particular, each cross-member 158 is configured to be releasably secured to the top surface 126 of the horizontal portion 120 of each frame rail 112, 114. The cross-members 158 preferably are releasably secured in place with spacer securing means 164. Specifically, the cross-members 158 are secured with fasteners 164 that are adapted to pass through openings 166 provided in the horizontal portion 162 of the cross-member 158 and through the openings 124 provided in each frame rail 112, 114 to thread into a backer bar 168 which includes at least one threaded opening 170. Each backer bar 168 is substantially rectilinear in shape and is formed of a substantially rigid material such as steel. Normally, each backer bar 168 includes a pair 172 of threaded openings 170 which corresponds to one of the pairs 130 of openings 124 provided in the frame rails 112, 114. As indicated most clearly in FIGS. 4–6, each backer bar 168 can be provided with an oblique edge 174 which facilitates close contact between the backer bar and its associated frame rail 112, 114. Additionally, depicted in FIG. 3 are fastener end caps 176 which protect the threads of the fasteners 164 from contamination by the hardenable material which is poured to form the completed trench.

Figure 4:
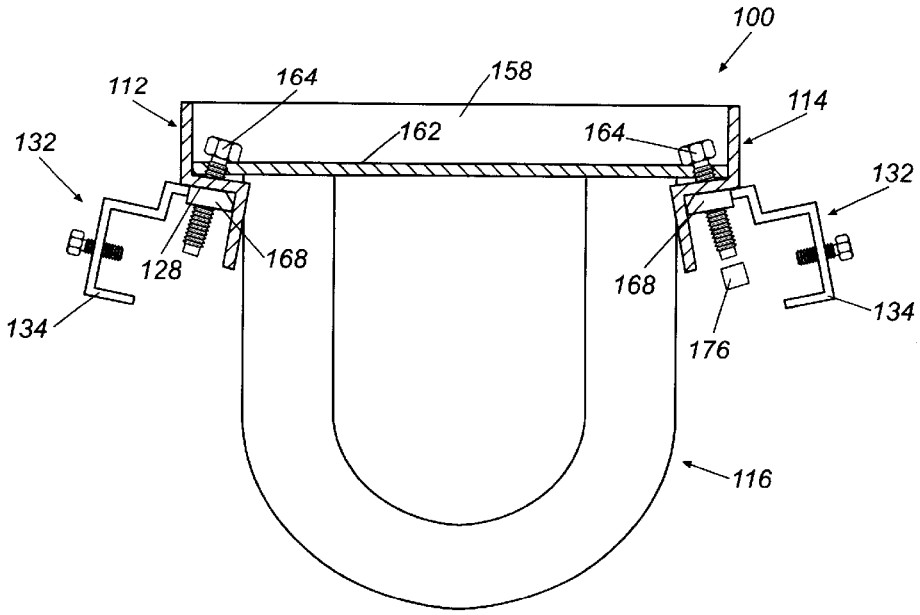
FIG. 4 illustrates a partial cross-sectional end view of the apparatus of FIG. 3, shown in a partially assembled state.

FIG. 4 depicts the trench forming apparatus 100 in a partially assembled state prior to its positioning in the excavated trench. As indicated in this figure, each frame rail 112, 114 is positioned adjacent the lateral edges of the upper surface 150 of the removable form 116. To maintain the frame rails 112, 114 in this position, the cross-members 158 are used to support the frame rails 112, 114. In particular, the fasteners 164 are passed through the openings 166 provided in the cross-members 158 and are threaded into their respective backer bars 168. In that the openings 166 provided in the cross-member 158 are positioned such that the distance between the frame rails 112, 114 is less than the width of the upper surface 150 of the removable form 116 when the fasteners 164 are threaded into their backer bars 168, the frame rails and their associated support brackets 134 tow outwardly as indicated in FIG. 4. However, when the fasteners 164 are fully tightened into their backer bars 168, the frame rails 112, 114 rotate inwardly towards the removable form 116 and compress the form therebetween (FIG. 5) to hold the form in place prior to pouring of the hardenable material. In addition to this compressive action, the form 116 can be secured with polymeric push pins (not shown) or other such fasteners that extend from the second vertical portion 122 of the frame rails 12, 114 into the form.

Figure 5:
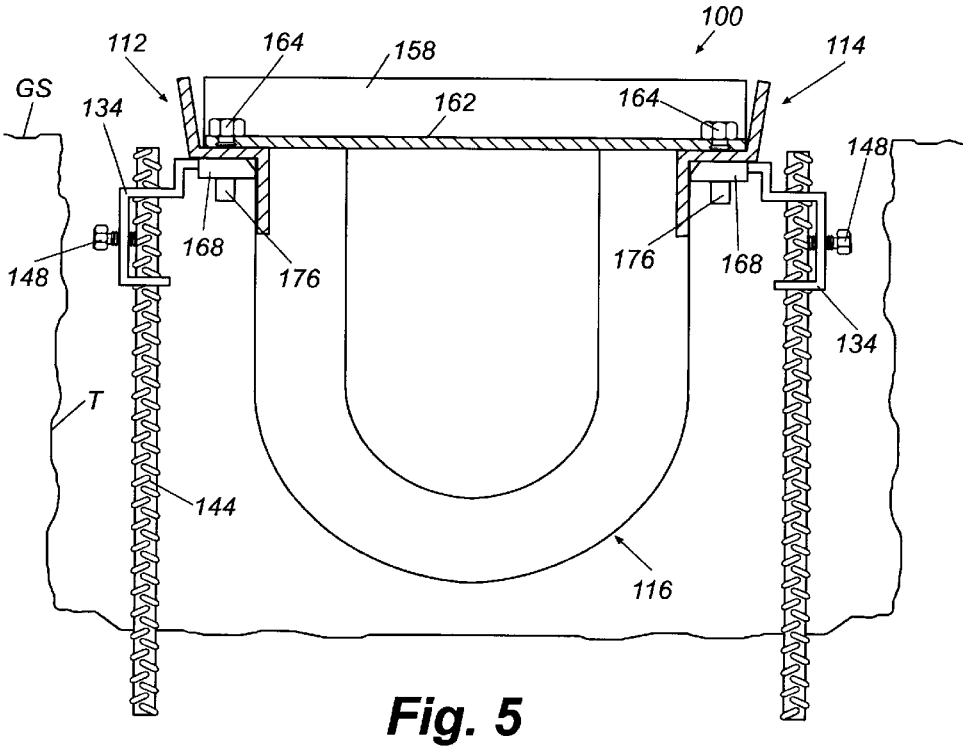
FIG. 5 illustrates a partial cross-sectional end view of the apparatus of claim 4, shown in a fully assembled state.

FIG. 5 shows the trench-forming apparatus 100 disposed in an excavated trench T apparatus prior to the pouring of the hardenable material such as concrete. Before being so disposed, however, the apparatus is fully assembled by completing tightening of the fasteners 164 such that the removable form 116 is held in place in compression between the two frame rails 112, 114. Configured in this manner, the removable form 116 is held in place between the frame rails 112, 114 prior to pouring of the hardenable material into the excavated trench T. After the fasteners 164 have been fully tightened, the end caps 176 can be placed over the exposed ends of the fasteners as shown in FIG. 5. Once placed in the trench, the apparatus 100 is supported by its support brackets 134 and the support rods 144 that extend through each respective bracket. At this point, the height and slope of the apparatus 100 can be adjusted by varying the points at which the fasteners 148 are tightened along the length of the support rods 144. Normally, the height of the form 116 exceeds that of the surrounding ground surface GS so that when the hardenable material is poured it will cover the ground surface, as well as meet the top edge of each frame rail 112, 114.

Figure 6:
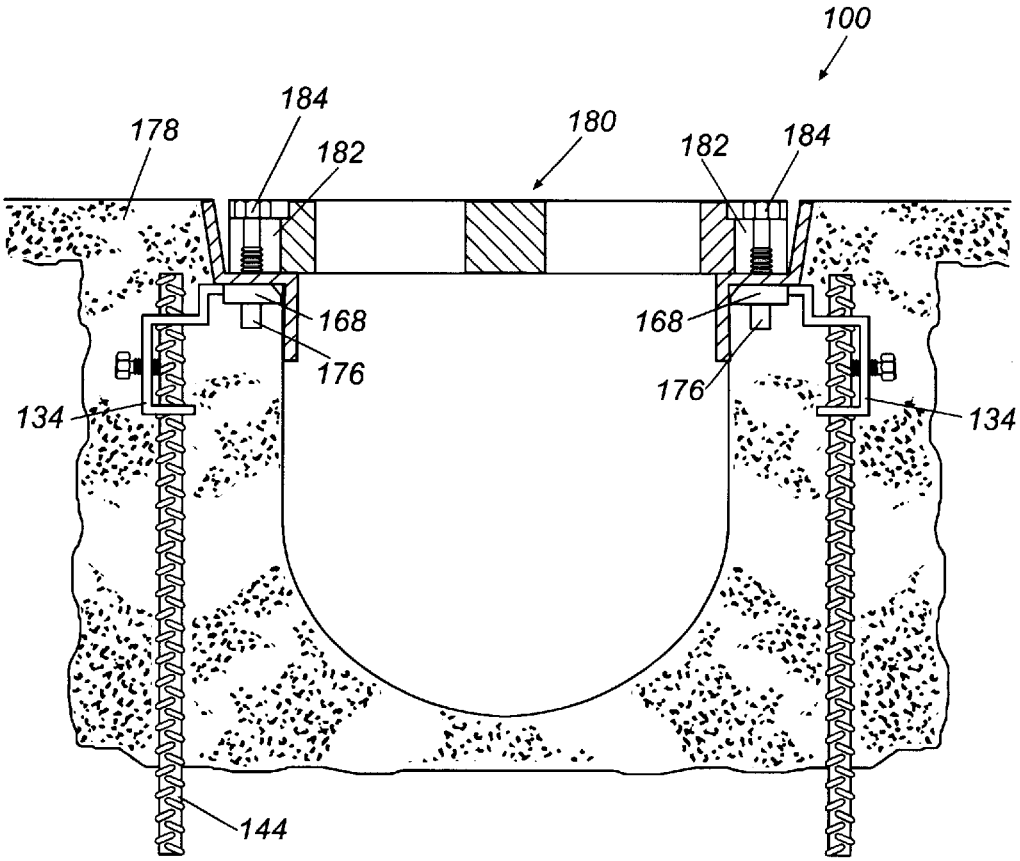
FIG. 6 illustrates a completed trench formed with the apparatus of FIG. 3.

FIG. 6 illustrates the completed trench in its final configuration. As indicated in this figure, the trench-forming apparatus 100 is surrounded by a hardenable material 178 such as concrete. Prior to the curing of the hardenable material 178, the cross-members 168 provide the resistance needed by the form to resist the buoyancy forces imposed by the hardenable material. In particular, this resistance is provided by the relatively large contact surface area between the cross-members 168 and the form 116. As is apparent from the figure, each support bracket 134 and support rod 144 is encased within the hardenable material 178 such that they cannot be reused. At this point, the cross-member 158 shown in FIGS. 4 and 5 has been removed along with the removable form 116. In particular, each fastener 164 which releasably secured the cross-member in place is removed such that grates 180 can be positioned atop the top surface 126 of the horizontal portion 120 of each frame rail 112, 114. As briefly mentioned above, the openings 126 provided in the frame rails 112, 114 (and therefore the threaded openings 170 provided in the backer bars 168) are configured so as to facilitate lock-down of the grates 180. Specifically, these openings are arranged so as to align with lock-down bolt openings 182 provided in each of the grates 180. Accordingly, when each fastener 164 is removed, a threaded opening remains for each lock-down opening 182 such that grate lock-down bolts 184 can be threaded into each backer bar 168 to fixedly secure the grates 180 in place atop the rails 112, 114. In hat each fastener 164 was covered by a fastener cap cover 176, the threads of each backer bar 168 are clean and free from contamination by the hardenable material 178 such that the lock-down bolts 184 simply can be threaded into the threaded openings 170 of the backer bars without the need for re-tapping or clearing these openings.

Figure 7:
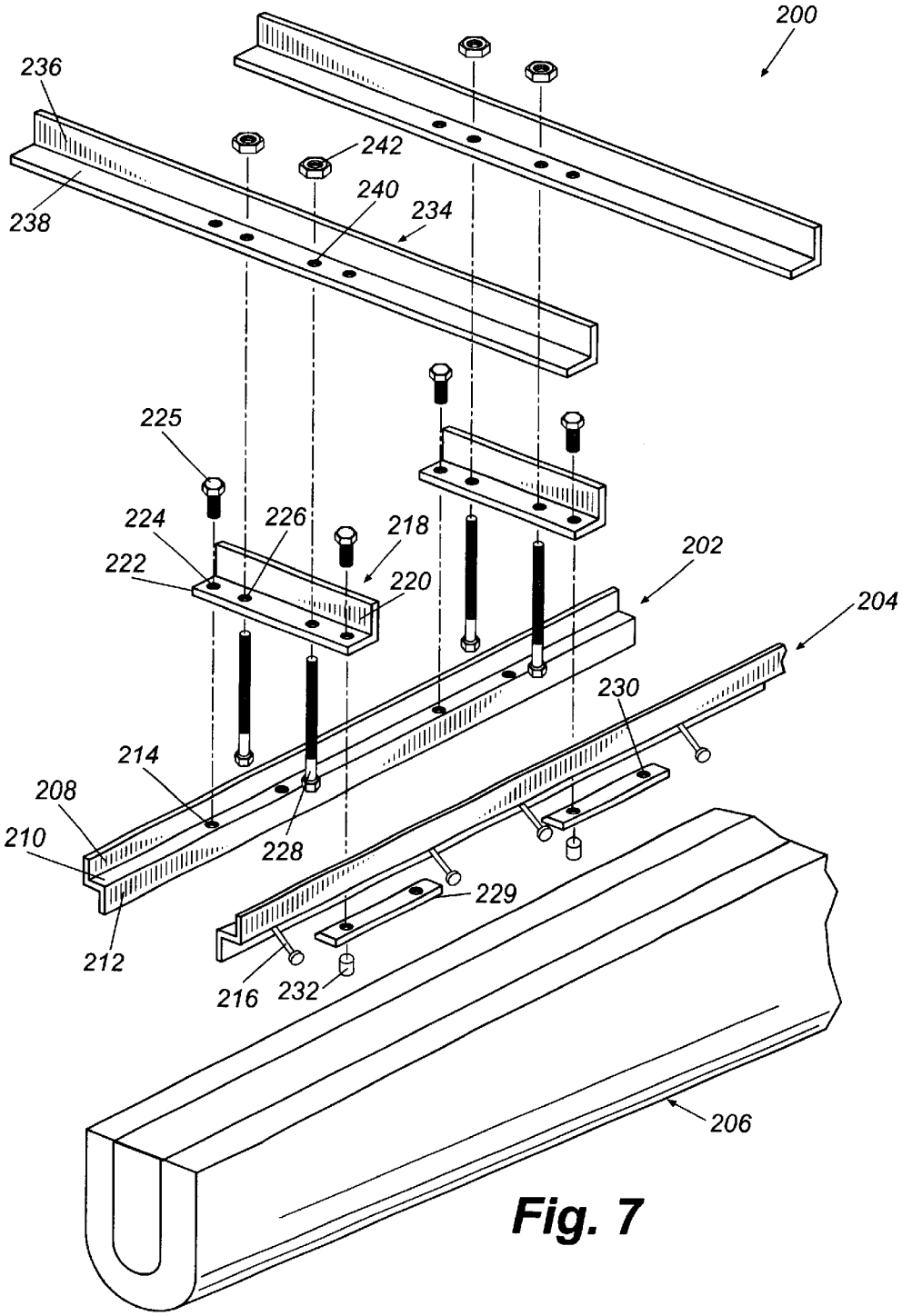
FIG. 7 illustrates an exploded perspective view of a second embodiment of trench forming apparatus constructed in accordance with the present invention.
Figure 8:
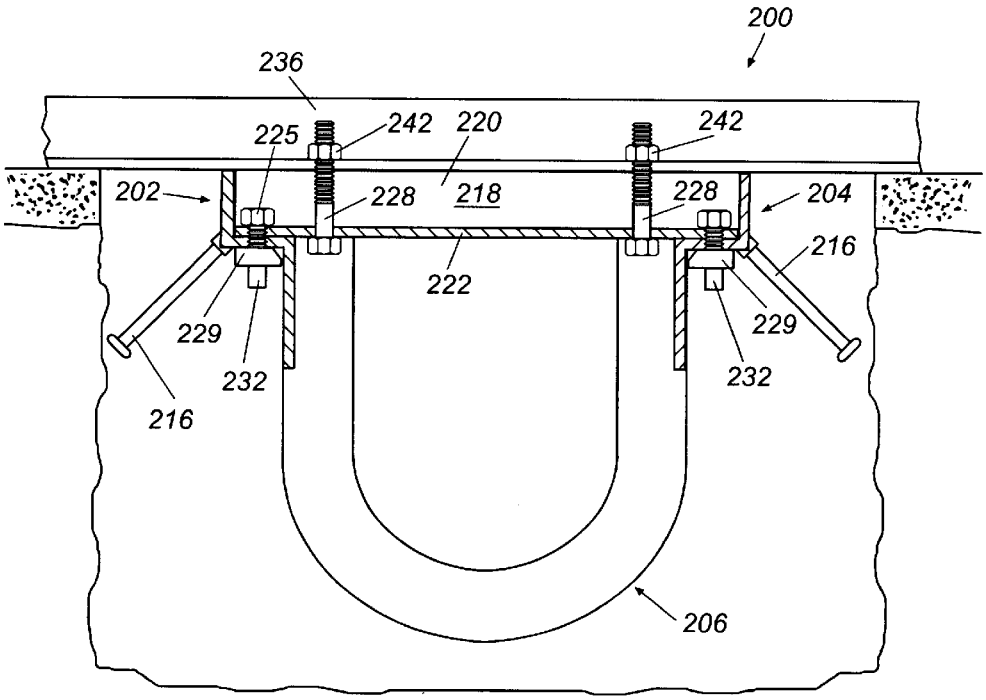
FIG. 8 illustrates a partial cross-sectional end view of the apparatus of FIG. 7, shown in a fully assembled state.
Figure 9:
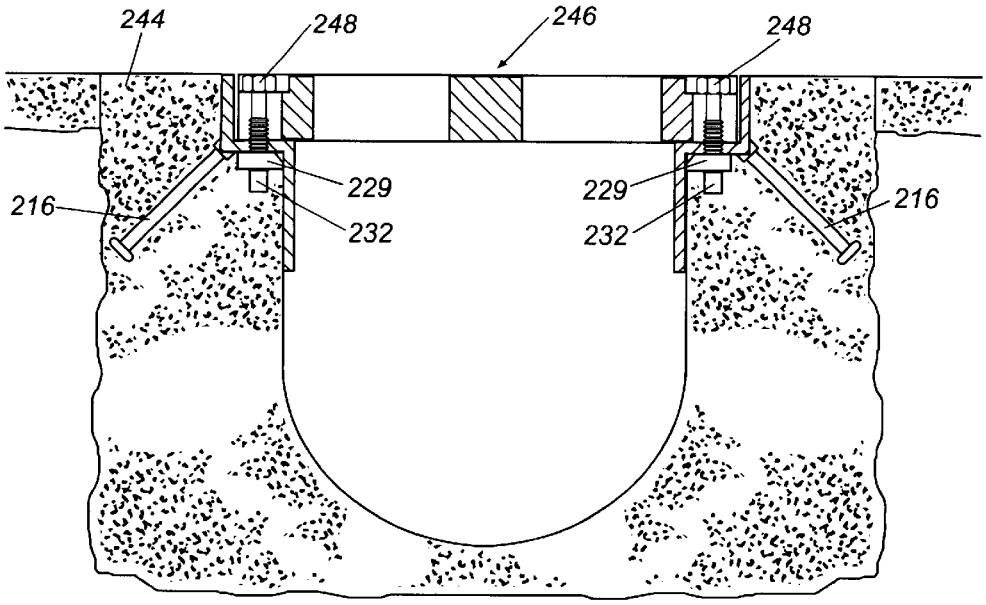
FIG. 9 illustrates a completed trench formed with the apparatus of FIG. 7.

FIGS. 7–9 illustrate an exploded perspective view of a second embodiment of the trench-forming apparatus 200 constructed in accordance with the present invention. This apparatus 200 is similar to the apparatus 100 of the first embodiment, however, is configured as a hanging system as will be described below. As with the apparatus 100 of the first embodiment, the apparatus 200 of the second embodiment comprises first and second frame rails 202 and 204, a removable form 206, and rail spacing means. The frame rails 202, 204 include a first vertical portion 208, a horizontal portion 210, and a second vertical portion 212. As in the first embodiment, the horizontal portion 210 of the frame rails 202, 204 are provided with spaced pairs of openings 214. However, unlike the frame rails 102, 104 of the first embodiment, the frame rails 202, 204 of the second embodiment are not provided with support members 132, but are instead provided with stabilizing studs 216 that extend downwardly and outwardly from the horizontal portions 210 of the frame rails 202, 204. The stabilizing studs 216 stabilize the frame rails 202, 204 after the hardenable material has been poured around the form 206 in the trench. It is to be noted that, although such stabilizing studs are not shown as included with the form assembly 100 of the first embodiment, that such stabilizing studs could be provided on the frame rails 102, 104 of the first embodiment, if desired.

Similar to the rail spacing means provided in the first embodiment, the rail spacing means of the second embodiment comprise cross-members 218. These cross-members 218 normally each include a vertical portion 220 and a horizontal portion 222. The horizontal portions 222 are provided with a first pair of openings 224 so that the cross-members 218 can be removably secured to the frame rails 202, 204 with fasteners 225. The cross-member 218 further include in similar manner as these in the first embodiment an inner pair of openings 226 which are sized and configured to receive fasteners 228. The apparatus 200 of the second embodiment further includes backer bars 229 that are of similar configuration to those described in the discussion of the first embodiment and therefore include threaded openings 230. In addition, the apparatus further includes fastener end caps 232.

As briefly mentioned above, the trench-forming apparatus 200 is configured as a hanging system and therefore is arranged to be suspended within the excavated trench T prior to and during pouring of the hardenable material. To facilitate this suspension, the apparatus 200 also includes suspension members 234. Typically each suspension member 234 is similar in construction to the cross-members 218 and therefore includes a vertical portion 236, as well as a horizontal portion 238. The horizontal portions 238 are provided with a pair of openings 240 which, like the inner pair of openings 226 provided in the cross-member are sized and configured to receive the fasteners 228.

To construct a completed trench, the apparatus is suspended within the excavated trench T as shown in FIG. 8. To suspend the form assembly 200 within the trench T, the cross-members 218 are connected to the suspension members 234 with the fasteners 228. Specifically, the fasteners are passed through the openings 226 provided in the cross-members 218 and openings 240 provided in the suspension members 234, and are secured with nuts 242. The apparatus 200 can then be suspended as indicated in FIG. 8 by the suspension members 234. At this point, the hardenable material 244 can be poured around the form 206 as indicated in FIG. 9 to secure the apparatus 200 in place at the work site. Then, in like manner to the apparatus 100 of the first embodiment, a perforated grate 246 can be installed on the formed trench and secured thereto with lock-down bolts 248.

Figure 10:
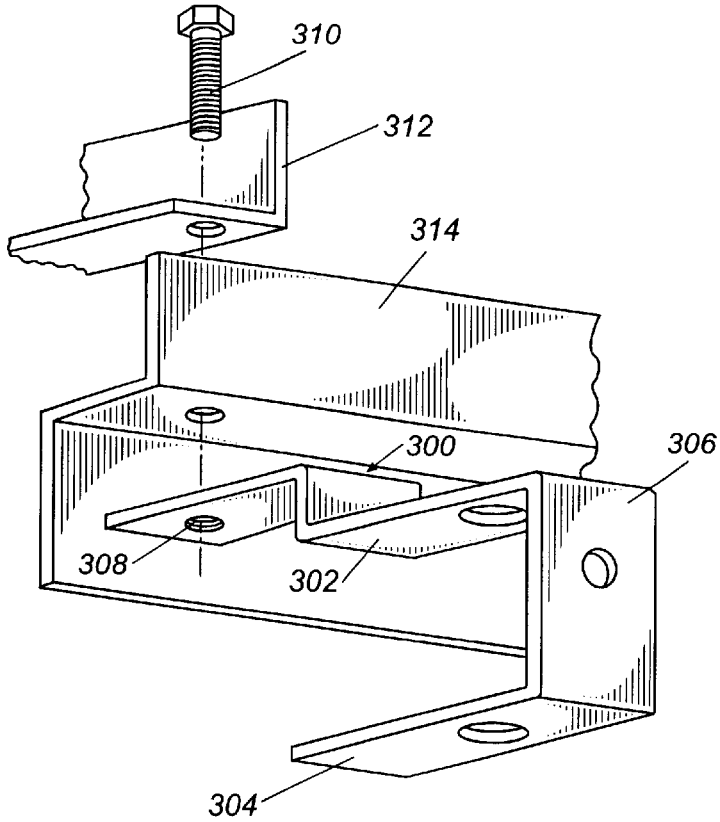
FIG. 10 illustrates a first alternative spacer securing means.
Figure 11:
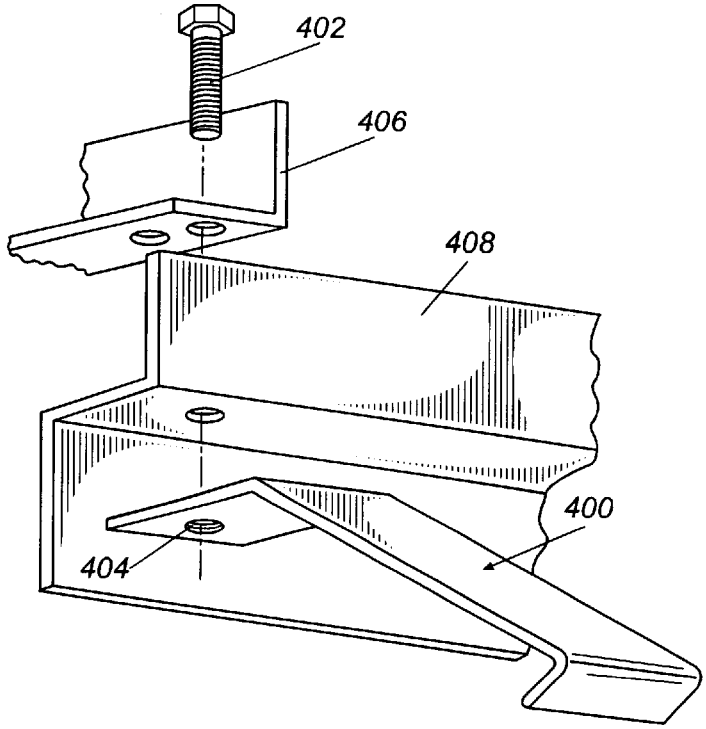
FIG. 11 illustrates a second alternative spacer securing means.
Figure 12:
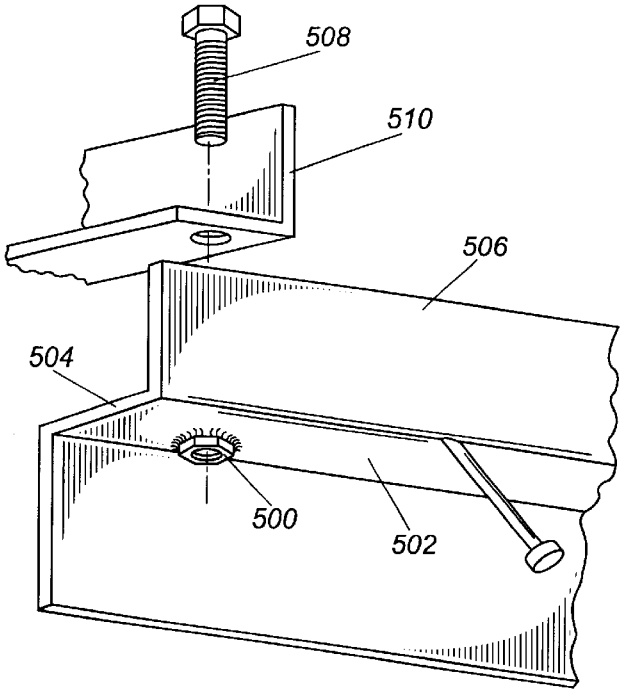
FIG. 12 illustrates a third alternative spacer securing means.

FIGS. 10–13 illustrate various alternatives for the spacer securing means used to removably secure the cross-members (or other such spacers) to the frame rails. In particular, FIGS. 10–12 show alternatives to the backer bars described in the discussion of the first two embodiments. In FIG. 10, the backer bar is replaced with a support bracket 300 that is similar in form to the support brackets 134 of the apparatus 100 of the first embodiment. Similar to those support brackets, the support bracket 300 includes first and second horizontal portions 302 and 304 and a vertical portion 306. In this arrangement, however, the first horizontal portion 302 is provided with a threaded opening 308 that is adapted to receive a fastener 310 that passes through the cross-member 312 and the frame rail 314. When the support bracket 300 is used, the cross-member 312 as well as the support bracket can be securely fastened to the frame rail 314 by tightly threading the fastener 310 through the support bracket.

In FIG. 11, the backer bars are replaced with stabilizing bars 400. Although the stabilizing bars 400 can be used in either the apparatus of the first embodiment or of the second embodiment, the stabilizer bars are particularly well suited for a hanging system similar to that of the second embodiment. Like the support bracket 300, the stabilizing bar 400 receives the fastener 402 in a threaded opening 404 to fasten both the cross-member 406 and the stabilizer bar in place relative to the frame rail 408.

In FIG. 12, a nut 500 is welded to the bottom surface 502 of the horizontal portion 504 of the frame rail 506. Like the support brackets 300 and the stabilizing bar 400, this nut receives a fastener 508 which passes through the cross-member 510 and the frame rail 506 to fasten the cross-member to the frame rail. Although a nut 500 is depicted in FIG. 12, it will be understood that the frame rail 506 could equivalently be provided with its own threaded opening that is adapted to threadingly receive the fastener 508.

Figure 13:
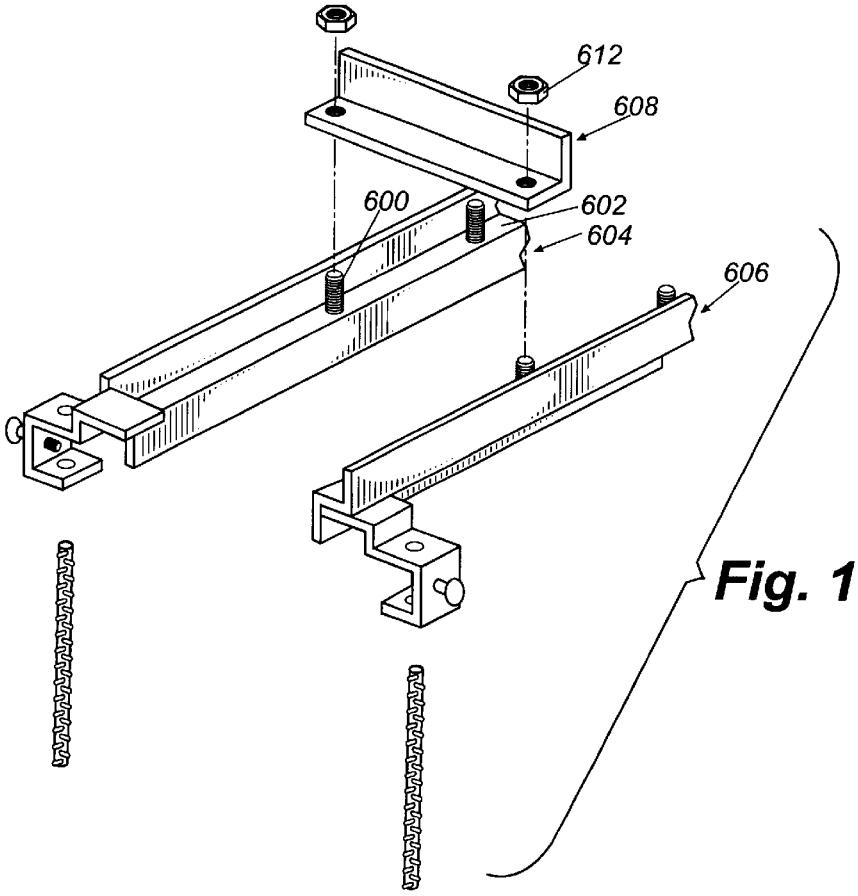
FIG. 13 illustrates a fourth alternative spacer securing means.

FIG. 13 illustrates an embodiment in which a separate fastener is not needed to secure a cross-members to the frame rails. Instead, threaded studs 600 are welded to the horizontal portion 602 of each frame rail 604, 606. In this manner, the cross-member 608 can be releasably secured to the frame rails 604, 606 by seating the cross-member in place on the rails with the threaded studs 600 passing through openings 610 provided in the cross-member. The cross-member 608 can then be secured to the rail 604, 606 by threading nuts 612 onto the threaded studs 600.

One advantage of the various embodiments of the present invention includes the relative low cost associated with trench construction with these embodiments. For instance, the same securing means used to secure the spacers such as the cross-members can be utilized to lock-down the trench grates. This feature is desirable since it reduces manufacturing costs of the frame rails for applications in which locking-down of the grating is required. Furthermore, this feature avoids some of the manufacturing difficulties associated with providing lock-down means in conventional trench-forming systems. Because several of the components of the systems described herein can be removed, further savings can be achieved by reusing these removed components. The present invention further lowers costs by eliminating the labor associated with welding connecting rods in place, and cutting these connecting rods off after completion of the trench.

In addition to the above-recited advantages, the systems described herein provide the benefit of a more rigid connection between the frame rails for increased precision of alignment and spacing of the form rails. Moreover, due to the compressive forces imposed on the removable form from the frame rails, the form can be maintained in correct orientation relative to the frame rails until the hardenable material has cured. Due to these factors, the resultant trench is more precisely formed, therefore avoiding the typical drainage problems encountered with known conventional trench-forming systems.

While preferred embodiments of the invention have been disclosed in detail in the foregoing description and drawings, it will be understood by those skilled in the art that variations and modifications thereof can be made without departing from the spirit and scope of the invention as set forth in the following claims. For instance, although described as comprising horizontal and vertical portions, the cross-members could be formed, for example, as flat bars or substantially rod-shaped members, if desired. The cross-members could be arranged in any configuration which ensures correct alignment and spacing of the frame rails. Indeed, it is to be appreciated that the grates themselves could be used to provide the alignment and spacing normally provided by typical spacers such as the herein described cross-members.

What is claimed is:

1. An apparatus for forming a trench which is adapted to receive at least one grate that covers the trench, said apparatus comprising:

first and second frame rails adapted to line the top edges of the trench, each frame rail having a horizontal portion that includes a plurality of openings that are spaced in a configuration so as to align with lock-down openings provided in the grate or grates when used to cover the trench;

at least one removable spacer sized and configured to maintain proper alignment and spacing between said first and second frame rails, said spacer having at least one opening provided therein that is oriented so as to align with at least one of said openings provided in one of said frame rails; and spacer securing means for releasably securing said at least one removable spacer to each of said first and second frame rails, at least a portion of said securing means being usable for locking-down the grate or grates to the trench after said removable spacer has been removed.

2. The apparatus of claim 1, wherein said openings provided in said frame rails are arranged in spaced pairs along the lengths of said frame rail horizontal portions such that one opening of each pair is adapted to align with a lock-down opening of a separate grate.

3. The apparatus of claim 1, wherein each of said frame rails further comprises a first vertical portion that extends upwardly from said horizontal portion and a second vertical portion that extends downwardly from said horizontal portion such that each frame rail is substantially Z-shaped in cross-section.

4. The apparatus of claim 1, wherein said spacer is formed as a cross-member having a vertical portion and a horizontal portion.

5. The apparatus of claim 1, wherein said securing means includes a threaded fastener that is sized and shaped to pass through said at least one opening of said spacer and at least one of said openings of said frame rails.

6. The apparatus of claim 5, wherein said securing means further includes a backer bar having at least one threaded opening which is sized and configured to threadingly receive said fastener.

7. The apparatus of claim 5, wherein said securing means further includes a support bracket having at least one threaded opening which is sized and configured to threadingly receive said fastener.

8. The apparatus of claim 5, wherein said securing means further includes a stabilizer bar having at least one threaded opening which is sized and configured to threadingly receive said fastener.

9. The apparatus of claim 5, wherein said securing means further includes a nut that is welded to said horizontal portion of each frame rail and which is sized and configured to threadingly receive said fastener.

10. The apparatus of claim 5, further comprising a fastener end cap that is sized and configured to fit about an end of said fastener to shield it from contaminants.

11. The apparatus of claim 1, further comprising a removable form that is configured to be held in place between said frame rails during formation of the trench.

12. The apparatus of claim 11, wherein said at least one removable spacer has at least two openings that are spaced such that the distance between said frame rails is slightly smaller that the width of said removable form when said at least one removable spacer is fully secured to said frame rails.

13. An apparatus for forming a trench which is adapted to receive at least one grate that covers the trench, said apparatus comprising:

first and second frame rails adapted to line the top edges of the trench;

at least one removable spacer sized and configured to maintain proper alignment and spacing between said first and second frame rails; and spacer securing means for releasably securing said at least one removable spacer to each of said first and second frame rails, at least a portion of said securing means being usable for locking-down at least one grate to the trench after said removable spacer has been removed.

14. The apparatus of claim 13, wherein each frame rail includes a horizontal portion that includes a plurality of openings.

15. The apparatus of claim 14, wherein said openings provided in said frame rails are arranged in spaced pairs along the lengths of said frame rail horizontal portions such that one opening of each pair is adapted to align with a lock-down opening of a separate grate.

16. The apparatus of claim 15, wherein said at least one removable spacer includes at least one opening provided therein that is oriented so as to align with at least one of said openings provided in one of said frame rails.

17. The apparatus of claim 16, wherein said securing means includes a threaded fastener that is sized and shaped to pass through said at least one opening of said spacer and at least one of said openings of said frame rails, and a backer bar having at least one threaded opening provided therein which is sized and configured to threadingly receive said fastener.

18. The apparatus of claim 16, wherein said securing means includes a threaded fastener that is sized and shaped to pass through said at least one opening of said spacer and at least one of said openings of said frame rails, and a support bracket having at least one threaded opening provided therein which is sized and configured to threadingly receive said fastener.

19. The apparatus of claim 16, wherein said securing means includes a threaded fastener that is sized and shaped to pass through said at least one opening of said spacer and at least one of said openings of said frame rails, and a stabilizer bar having at least one threaded opening provided therein which is sized and configured to threadingly receive said fastener.

20. The apparatus of claim 16, wherein said securing means includes a threaded fastener that is sized and shaped to pass through said at least one opening of said spacer and at least one of said openings of said frame rails, and a nut that is welded to said horizontal portions of each frame rail and which is sized and configured to threadingly receive said fastener.

21. The apparatus of claim 13, wherein said securing means includes a threaded stud that extends upwardly from each frame rail.

22. A method for forming a trench, said method comprising the steps of:

positioning a frame rail at both of the top edges of a removable form, each frame rail having a grate engaging surface;

securing the frame rails in position on the removable form and relative to each other with spacing means releasably secured to securing means;

arranging the frame rails and form in a desired position within an excavated trench;

pouring a hardenable material into the excavated trench to surround the frame rails and removable form;

removing the removable form after the hardenable material has hardened;

placing at least one grate in position on the grate engaging surfaces of the frame rails; and fixedly securing the at least one grate in position on the frame rails with at least a portion of said securing means.

* * * * *